US006925844B2

(12) United States Patent
Liu

(10) Patent No.: US 6,925,844 B2
(45) Date of Patent: Aug. 9, 2005

(54) LOCK HAVING A HELICAL KEYWAY AND ACCOMPANYING KEY AND METHODS THEREFOR

(76) Inventor: Chien-Kuo Liu, No. 9, Lane 174, Datung Street, Beitou Chiu, Taipei (TW)

( * ) Notice: Subject to any disclaimer, the term of this patent is extended or adjusted under 35 U.S.C. 154(b) by 0 days.

(21) Appl. No.: 10/355,985

(22) Filed: Jan. 30, 2003

(65) Prior Publication Data

US 2004/0148987 A1 Aug. 5, 2004

(51) Int. Cl.[7] ..... E05B 9/04

(52) U.S. Cl. ..... 70/375; 70/358; 70/395; 70/407; 70/409; 70/403

(58) Field of Search ..... 70/395, 401, 403, 70/407, 409, 411, 375, 358, 359, 378, 393, 402, 412, 493

(56) References Cited

U.S. PATENT DOCUMENTS

| | | | | | |
|---|---|---|---|---|---|
| 63,230 | A | * | 3/1867 | Dickson | 70/407 X |
| 616,751 | A | * | 12/1898 | Vedder et al. | 70/407 X |
| 842,834 | A | * | 1/1907 | Hurdle | 70/407 X |
| 917,365 | A | * | 4/1909 | Schoell | 70/359 |
| 955,267 | A | * | 4/1910 | Hill | 70/347 |
| 1,036,764 | A | * | 8/1912 | Wilson | 70/491 |
| 1,932,706 | A | * | 10/1933 | Neer | 70/407 X |
| 2,107,834 | A | * | 2/1938 | Phillips | 70/409 |
| 3,421,383 | A | * | 1/1969 | Widmoyer et al. | 74/89.35 |
| 3,646,827 | A | * | 3/1972 | Patterson | 74/89.4 |
| 3,731,546 | A | * | 5/1973 | MacDonald | 74/63 |
| 4,454,735 | A | * | 6/1984 | Huang | 70/407 X |
| 5,131,247 | A | * | 7/1992 | Hsu | 70/375 X |
| 5,671,623 | A | * | 9/1997 | Hsu | 70/375 |
| 6,301,942 | B1 | * | 10/2001 | Shvarts | 70/367 |
| 6,758,074 | B1 | * | 7/2004 | Prunbauer | 70/366 |
| 2004/0000178 | A1 | * | 1/2004 | Tseng | 70/358 |
| 2004/0172992 | A1 | * | 9/2004 | Huang | 70/358 |

FOREIGN PATENT DOCUMENTS

| | | | | |
|---|---|---|---|---|
| AU | 485117 | * | 12/1975 | |
| DE | 214426 | * | 10/1909 | 70/407 |
| DE | 593541 | * | 2/1934 | 70/395 |
| FR | 2413520 | * | 8/1979 | 70/409 |
| GB | 1623 | * | 7/1855 | 70/409 |
| GB | 4665 | * | 3/1890 | 70/407 |
| GB | 2347 | * | 2/1891 | 70/407 |

* cited by examiner

*Primary Examiner*—Suzanne Dino Barrett
(74) *Attorney, Agent, or Firm*—Baker & McKenzie LLP

(57) ABSTRACT

The present application advantageously provides at least one keyway in a lock core that poses tremendous difficulty for a lock breaker by not allowing the lock breaker to see all of the pin tumblers in the keyway. The keyway according to a preferred embodiment of the present application comprises two helical keyways oppositely extending along a longitudinal axis of the lock core and formed of rectangular cross section. The present application further comprises an accompanying helical key having at least one helical key blade for fitting into the keyway having a corresponding helical shape to turn the core and open the lock.

26 Claims, 9 Drawing Sheets

LOCK HAVING A HELICAL KEYWAY AND ACCOMPANYING KEY AND METHODS THEREFOR

BACKGROUND OF THE INVENTION

1. Field of the Invention

The present invention generally relates to a cylinder lock and key combination, in particular, to a cylinder lock having one or more helical keyways and an accompanying key with helical key blade(s) to fit into the keyway(s) to open the lock.

2. Description of the Related Art

The prior art presents a number of cylinder locks with one or more sets of pin tumblers and pin tumbler bores situated next to a keyway formed in a straight line parallel to the direction of key insertion. The key includes a notch edge for engaging the tumblers contained in the lock cylinder, wherein insertion of a properly mated key permits rotation of the lock cylinder within the shell to unlock or enable a controlled element in a well known manner.

U.S. Pat. No. 1,961,586 describes a key and lock construction of a core and a single set of pin-tumblers. U.S. Pat. Nos. 4,434,636 and 4,638,651 describe cylinder locks with two sets of tumblers. In the prior art, the pin tumblers are mostly situated above a straight keyway and works along the profile of the upper edge of a straight key. Alternatively, an additional set of pin tumbler may be located at the bottom or side of similar keyway and works along the profile at the bottom or side of the key.

The customary practice of breaking a lock, or opening a lock without its key, is to look through the keyway, with the aid of a special eye piece, and insert into the keyway a rod to joggle the pin tumblers so that the meeting line between the pin tumblers and its drivers (meeting line), on top of the pin tumblers, coincides with the circumference of the cylinder core to thereby turn the core. Alternatively, without viewing, the lock breaker can joggle the pin tumblers by feeling or sensing the pin tumblers with the rod and turning the core simultaneously so that the meeting line coincides with the circumference of the cylinder core allowing the lock to be opened. No matter how many sets of pin tumblers there are in the lock, an experienced lock breaker can often successfully joggle the pin tumblers to turn the core as long as he can see or feel all of the pin tumblers in the keyway Thus, the ability to see or feel and joggle with all the pin tumblers in the keyway is the essence of lock breaking or opening a lock without its key. Once one can see or feel all the pin tumblers in the keyway, one is likely to break almost any lock.

Accordingly, there is a general need in the art for a lock with enhanced security that overcomes at least the aforementioned shortcomings in the art. In particular, there is a need in the art for a key that poses tremendous difficulty for an accomplished lock-picker by not allowing the lock-picker to see all of the pin tumblers in the keyway.

SUMMARY OF THE INVENTION

To overcome the above-mentioned shortcomings of conventional straight-shaped keyways, the present invention advantageously provides a lock and key combination that poses tremendous difficulty for a lock breaker by not allowing the lock breaker to see all of the pin tumblers in the keyway, which enhances lock security. Furthermore, the helical keyway of the lock of the present invention prevents the rod from successfully engaging the pin tumblers.

In one embodiment, the present invention provides a lock core comprising at least one helical keyway and at least one pin tumbler situated inside the lock core. In the lock core according to this particular embodiment, the at least one helical keyway extends spirally along a longitudinal axis of the lock core. In addition, the at least one helical keyway is formed with a rectangular, round, or polygonal cross section. In one preferred embodiment, the at least one helical keyway comprises two opposed helical keyways oppositely situated inside the lock core. The two opposed helical keyways may be of different cross sectional shapes. Moreover, the lock core further comprises a positioning slot in the center of one side thereof. The at least one pin tumbler is generally situated at a random location around the at least one helical keyway inside the lock core.

In another embodiment, the present invention provides a lock comprising a shell having a cylindrical opening, a lock core rotatably mounted in the cylindrical opening of the shell and having at least one helical keyway and at least one pin tumbler situated inside the lock core, and at least one pin tumbler bore for receiving the at least one pin tumbler, generally situated next to the at least one helical keyway. The at least one pin tumbler bore is generally situated at a random location around the at least one helical keyway The at least one helical keyway is formed with a rectangular, round, or polygonal cross section. In a preferred embodiment of the present invention, the at least one helical keyway comprises two opposed helical keyways oppositely situated inside the lock core. The two opposed helical keyways may be of different cross sectional shapes. The lock core further comprises a positioning slot in the center of one side thereof.

In yet another embodiment, the present invention provides a key comprising a key head and a key blade portion having at least one helical key blade extending spirally along a longitudinal axis thereof. The at least one helical key blade is formed with a rectangular, round, or polygonal cross section. In a preferred embodiment of the present invention, the at least one helical key blade comprises two opposed helical key blades extending oppositely along a longitudinal axis thereof. The two opposed helical key blades may be of different cross sectional shapes. Moreover, the at least one helical key blade comprises a contour profile thereon. The at least one helical key blade is integrated with the key head.

In yet another embodiment, the present invention provides a key comprising a key head, a shank connected to the key head at a first end thereof and provided with a protrusion at a second end thereof and having a pair of grooves extending oppositely laterally along a lengthwise direction thereof, a driving head movably mounted on the shank, the driving head having an inner opening in the center thereof and a cavity in one side thereof, the inner opening provided with a pair of protrusions oppositely located in the inner surface thereof, and a key blade portion rotatably movably mounted on the shank, the key blade portion comprising a blade head having an inner opening, a bearing assembly disposed between the blade head and the cavity of the driving head, and at least one helical key blade extending from the periphery of the inner opening of the blade head. The at least one helical key blade is formed with a rectangular, round, or polygonal cross section. The at least one helical key blade comprises a contour profile thereon. In addition, the bearing assembly comprises a first bearing member fixed in the inner surface of the cavity of the driving head and a second bearing member arranged adjacent to the outer surface of the blade head. The blade head is generally of a cylindrical shape fitted in the cavity of the driving head and has an inner opening through which the shank can pass.

Moreover, the at least one helical key blade according to the present invention is integrated with the blade head and extends along a longitudinal axis of the blade head from the periphery of the inner opening of the blade head. The at least one helical key blade comprises two helical key blades extending oppositely along a longitudinal axis of the blade head from the periphery of the inner opening of the blade head. Furthermore, the lock core comprises a fastening ring situated between the key blade portion and the driving head to retain the key blade portion within the cavity of the driving head. The key blade portion is rotated in a first direction to insert the at least one helical key blade into a corresponding keyway of a lock and in a second direction to retract the at least one helical key blade from the corresponding keyway. The at least one key blade further comprises a surface contour thereon.

In yet another embodiment, the present invention provides a lock and key combination comprising a shell having a cylindrical opening, a lock core rotatably mounted in the opening of the shell and having at least one helical keyway and at least one pin tumbler situated inside the lock core, at least one pin tumbler bore for receiving the at least one pin tumbler, generally situated next to the keyway, and a key having at least one helical key blade corresponding to the at least one keyway of the lock core. In the lock and key combination according to the particular embodiment of the present invention, the at least one helical keyway comprises two helical keyways oppositely located within the lock core. The at least one pin tumbler bore is generally situated at a random location around the keyway. In addition, the at least one helical keyway is formed with a rectangular, round, or polygonal cross section. In a preferred embodiment of the present invention, the at least one helical keyway comprises two helical keyways oppositely located within the lock core, the two helical keyways extends spirally along a longitudinal axis of the lock core. The key according to the particular embodiment of the present invention further comprises a key head, a shank connected to the key head, the shank having a pair of grooves oppositely laterally extending along a lengthwise direction thereof, a driver head having an inner opening in the center thereof and a cavity in one side thereof, the inner opening provided with a pair of protrusions oppositely located in the inner surface thereof, and a key blade portion received in the cavity of the driver head, the key blade portion comprising a blade head having an inner opening, a bearing assembly disposed between the blade head and the cavity of the driver head, and at least one helical key blade extending from the periphery of the inner opening of the blade head. The at least one helical key blade is formed with a rectangular, round, or polygonal cross section. The at least one helical key further comprises a contour profile thereon to work against the at least one pin tumbler. In addition, the bearing assembly comprises a first bearing member fixed in the inner surface of the cavity of the driving head and a second bearing member arranged adjacent to the outer surface of the blade head. The blade head is generally of a cylindrical shape and fitted in the cavity of the driving head and has an inner opening through which the shank can pass. Furthermore, the at least one helical key blade is integrated with the blade head and extends along a longitudinal axis of the blade head from the periphery of the inner opening of the blade head. The at least one helical key blade comprises two helical key blades extending oppositely along a longitudinal axis of the blade head from the periphery of the inner opening of the blade head. The lock and key combination according to the particular embodiment further comprises a fastening ring situated between the key blade portion and the driving head to retain the key blade portion within the cavity of the driving head. Moreover, the key blade portion is rotated in a first direction to insert the at least one helical key blade into a corresponding keyway of a lock and in a second direction to retract the at least one helical key blade from the corresponding keyway. The at least key blade comprises a surface contour thereon.

BRIEF DESCRIPTION OF THE DRAWINGS

The above and other aspects, features and advantages of the invention will be better understood by referring to the following detailed description, which should be read in conjunction with the accompanying drawings. These drawings and the associated description are provided to illustrate certain embodiments of the invention, and not to limit the scope of the invention.

DETAILED DESCRIPTION OF PREFERRED EMBODIMENTS

The following detailed description is directed to certain specific embodiments of the present invention. However, the present invention can be embodied in a multitude of different ways as defined and covered by the claims. The scope of the invention is to be determined with reference to the appended claims. In this description, reference is made to the drawings wherein like parts are designated with like numerals throughout.

Figure 1:
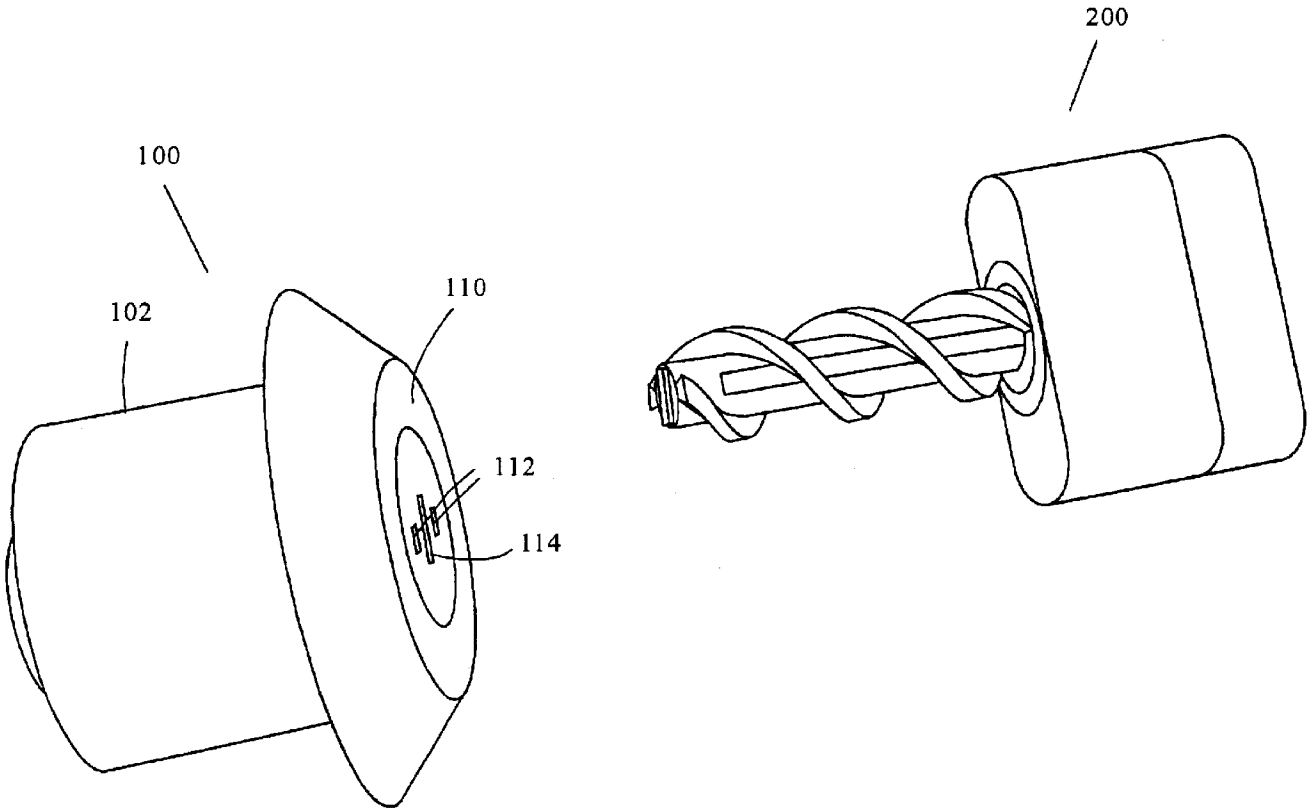
FIG. 1 is a perspective view of an embodiment of a lock and a key according to the present invention.

FIG. 1 illustrates a perspective view of an embodiment of a lock 100 and a corresponding key 200 according to the present invention. The lock 100 comprises a lock housing or shell 102 and a key core 110 rotatably disposed therein. The shell 102 may take various shapes, such as a cylinder lock shell, a mortise lock shell, a rim lock shell, etc. The lock core 110 is provided with a pair of keyways 112 for receiving the mated key 200 therein and a positioning slot 114 in the center of the front end for facilitating insertion of the key 200. Alternatively, the lock core may be provided with one or more keyways.

Figure 2A:
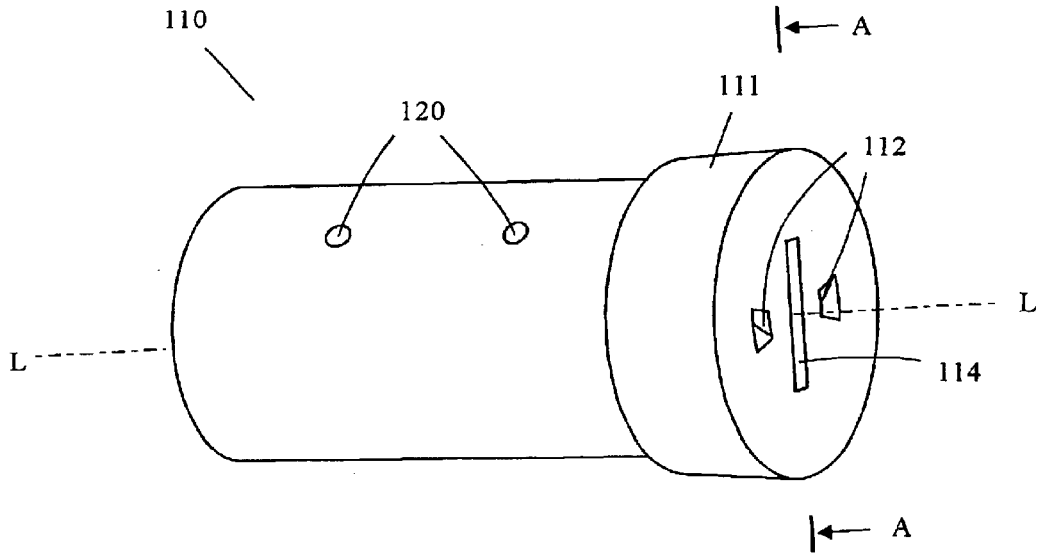
FIG. 2A is a perspective view of a lock core of the lock of FIG. 1.
Figure 2B:
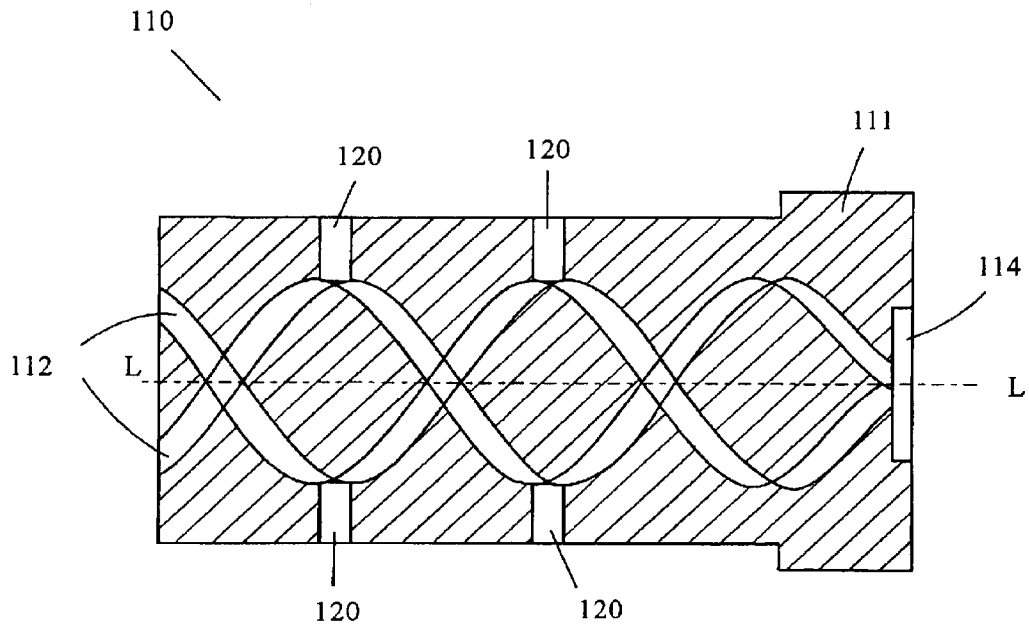
FIG. 2B is a cross-sectional view of the lock core taken along the line A—A of FIG. 2A.

FIG. 2A shows a perspective view of the lock core 110 of the lock 100. The lock core 110 terminates in a core head 111 and the slot 114 provided in the center thereof has a rectangular or polygonal cross section. Alternatively, the slot 114 may take on any shape. Each helical keyway 112 is provided with a rectangular cross section and generally lies next to the slot 114. FIG. 2B is a cross-sectional view of the lock core 110 taken along line A—A of FIG. 2A. The helical keyways 112 extend spirally along a longitudinal axis L—L of the lock core 110 and lie oppositely to one another. Alternatively, the keyways in a single lock core may be of different cross sectional shapes. The helical keyways 112 are formed in a clockwise (right-hand) direction so that a corresponding key may be rotatably inserted into the keyways in a clockwise direction. Alternatively, the helical keyways and the accompany key may be formed in a counterclockwise (left-hand) direction as long as they are mutually matched.

In a preferred embodiment of the present invention, there are provided two keyways oppositely situated inside the lock core 110. Additionally, it has been found that the keyways may be of rectangular or square cross section. Lock cores provided with different quantity and cross-sectional shape of the keyways will also produce the same results. For instance, the cross section of the keyway may be of the shape of round, triangular, polygon, parallelogram, etc, and the number of the keyway may be of one, two, three or more so long as the keyway(s) are appropriately arranged around the longitudinal axis of the lock core.

Referring to FIGS. 2A and 2B, a plurality of pin tumbler bores 120 are situated at a random locations adjacent to the keyways 112 for receiving tumblers (not shown). Alternatively, the pin tumbler bores 120 may be situated next to the keyways 112 at any location around the keyways 112 to form a specific, irregular distribution arrangement.

Figure 3:
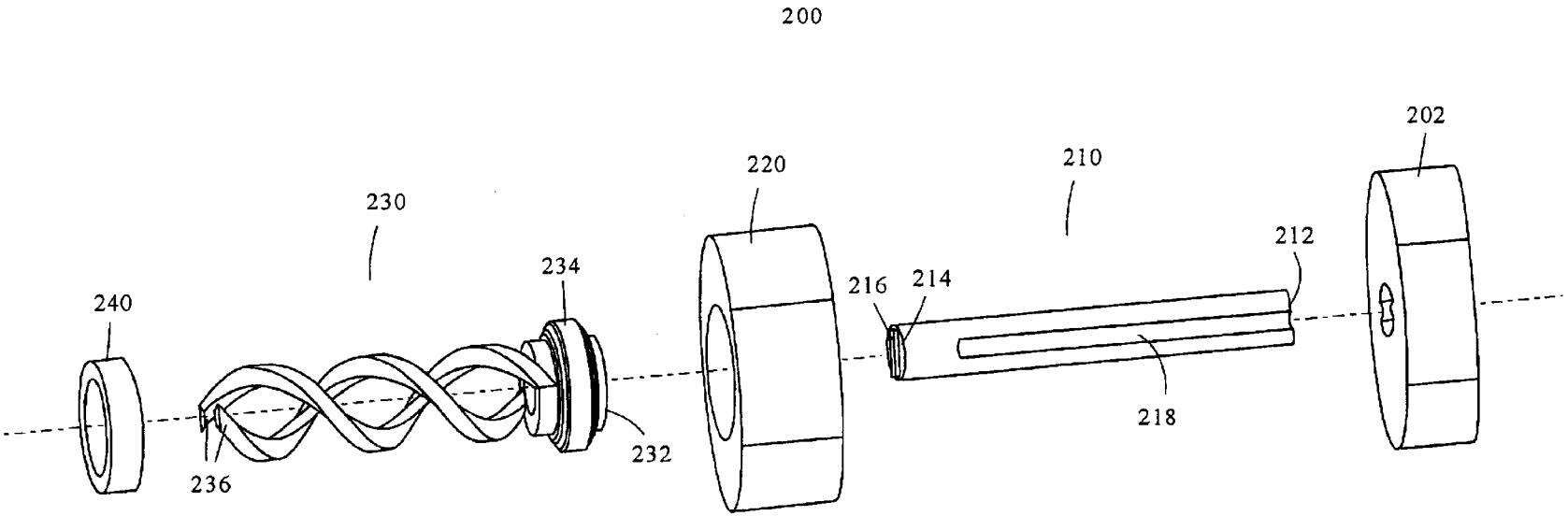
FIG. 3 is an exploded perspective view of the key of FIG. 1.

FIG. 3 shows an exploded perspective view of the helical key 200 of the present invention. The helical key 200 comprises a head 202, a shank 210, a driver head 220, a key blade portion 230 and a fastening ring 240. The head 202 is formed of a substantially cylindrical shape. The shank 210 is connected to the center of the head 202 at one end 212, having a protrusion 216 in the opposite end 214. A pair of grooves 218 oppositely laterally extends along the lengthwise direction of the shank 210 from the end 212 and terminates at a predetermined position in front of the protrusion end 214 of the shank 210.

Figure 4B:
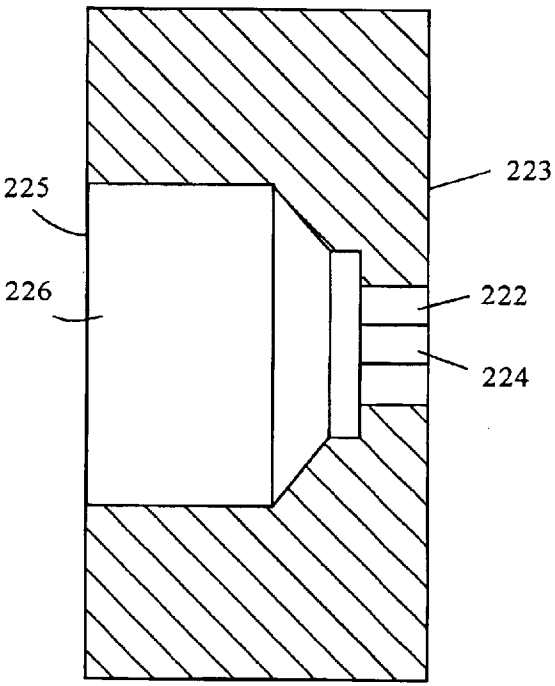
FIG. 4B is a cross-sectional view of the driver head taken along the line B—B of FIG. 4A.
Figure 4A:
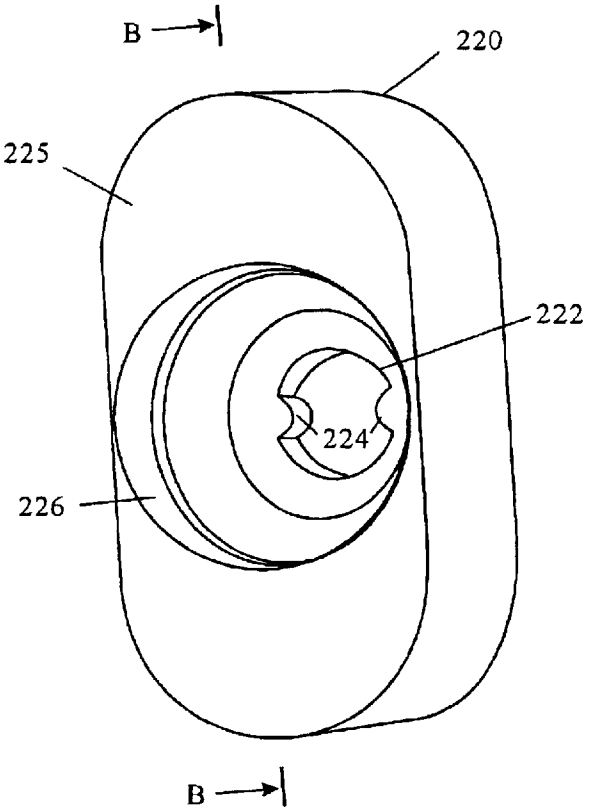
FIG. 4A is an enlarged perspective view of the driver head of FIG. 3.

As can be seen in FIGS. 4A and 4B, the driver head 220 of the present invention is generally formed with the same shape as the head 202, i.e. a substantially cylindrical shape. In the driver head 220, an opening 222 is formed in the center of one side 223 and a cavity 226 is formed in the center of the other side 225. The opening 222 and cavity 226 are coaxial. A pair of protrusions 224 is provided oppositely in the inner surface of the opening 222 such that the protrusions 224 matingly engage the grooves 218 of the shank 210 when the shank 210 is inserted in the opening 222 of the driver head 220, thereby help the driver head slidably move along the grooves on the shank. Since the grooves 218 of the shank 210 are terminated at a predetermined position in front of the end 214 of the shank 210, the driver head is movable in the lengthwise direction of the shank 210 between the both ends of the grooves 218. Such design will prevent the driver head from being deviated from the shank.

Figure 5:
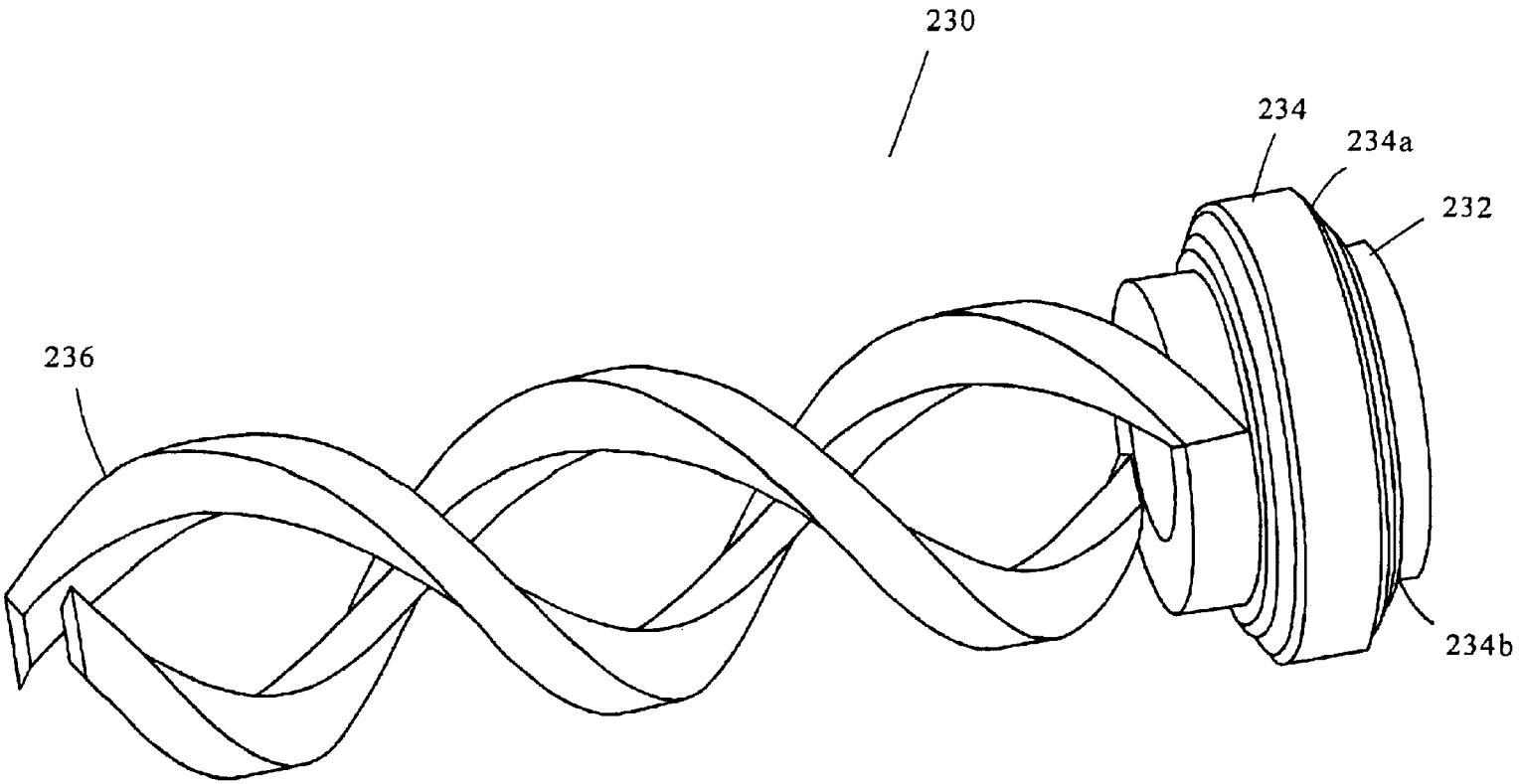
FIG. 5 is an enlarged perspective view of the key blade portion of FIG. 3.

Referring now to FIG. 5, the key blade portion 230 includes a blade head 232, a bearing assembly 234 and a pair of helical key blades 236 formed at a predetermined helical angle. The blade head 232 is generally of a cylindrical shape and fitted in the cavity 226 of the driver head 220 and has an opening through which the shank 210 can pass. Preferably, the diameter of the opening of the blade head 232 is the same as or slightly larger than that of the shank 210, so that the blade head 232 is closely fit with the shank 210. Between the blade head 232 and the shank 210, a clearance within a certain tolerance range is allowed, which tolerance range permits the blade head 232 to be stably moved and rotated on the shank 210 without producing vibration. Moreover, the helical key blades 236 may have a specific contour profile (not shown) thereon to work against the pin tumbler(s) to determine the respective meeting lines so that when the meeting line between the pin tumbler(s) and the driver(s) (not shown) coincide with the circumference of the lock core, the lock core may be turned.

Typically, the bearing assembly 234 has an outer bearing member 234*a* and an inner bearing member 234*b* in spaced relationship from one another with a plurality of bearings (not shown) interposed between the bearing members to permit relative rotation between the bearing members about the rotational axis. In one preferred embodiment of the present invention, the bearing assembly 234 is disposed between the driving head 220 and the key blade portion 230 to provide a relative rotation therebetween. The outer bearing member 234*a* is arranged adjacent to the inner surface of the cavity 226 of the driver head 220 and the inner bearing member 234*b* is firmly fixed to the outer surface of the blade head 232.

Figure 8:
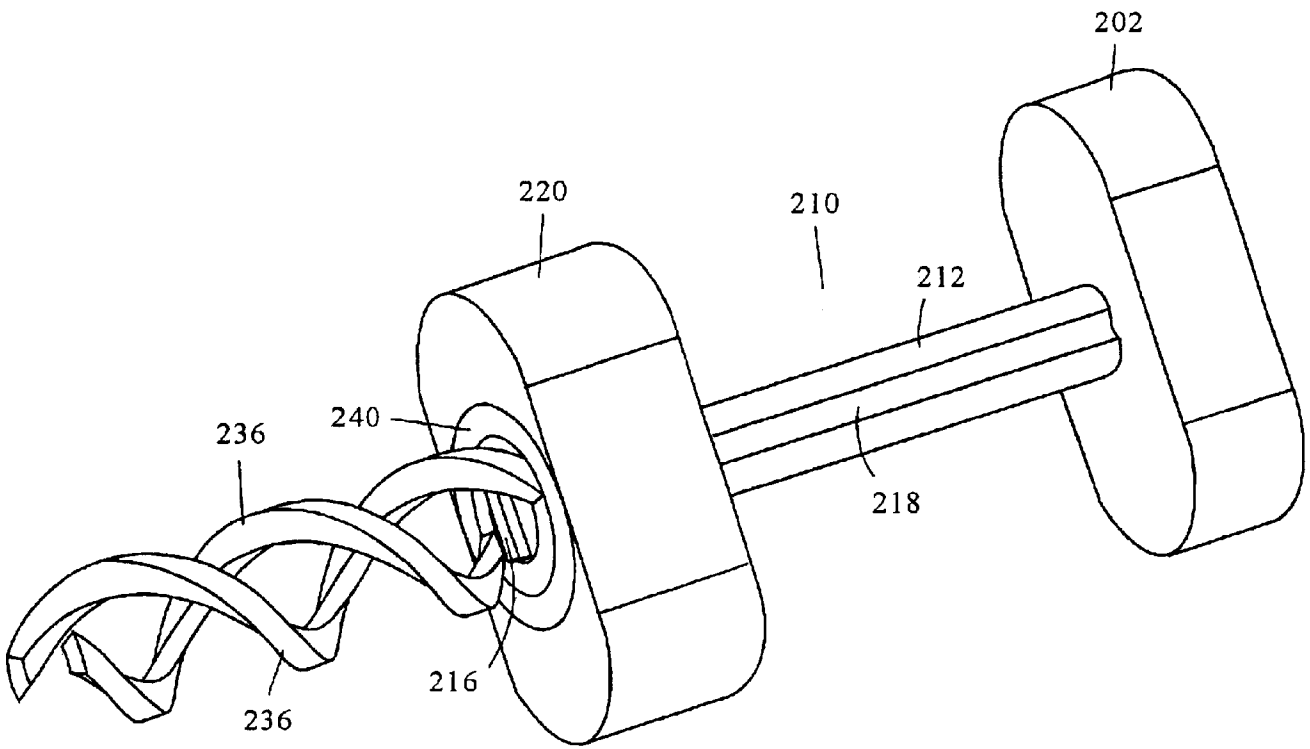
FIG. 8 is a perspective view of the key with the driver head and the key blade in the extended position.

The helical key blades 236 are preferably integrated with the blade head 232 and extend oppositely along a longitudinal axis of the blade head from the periphery of the inner opening within the blade bead 232. Each helical key blade 236 has a rectangular cross section corresponding to that of the keyways 112 and a substantially flattened end, the flattened end being obtained by horizontal flattening of the cross section of the helical key blade. As shown in FIG. 5, the helical key blades 236 are formed with same length. Alternatively, the helical key blades 236 may be of different lengths. A fastening ring 240 is provided between the key blade portion 230 and the driver head 220 to retain the key blade portion within the cavity 226 the driver head 220. Based on the above-described construction, the key blade portion is rotatable relative to the driver head and movable along the shank between an operating position (i.e., an extended position, as shown in FIG. 8) and a rest position (i.e., a retracted position, as shown in FIG. 1). Although shown in the figures is a pair of right-hand helical blade, i.e., clockwise insertion rotation, the helical blade may also be constructed as a left-hand helical blade, i.e., counterclockwise insertion rotation as long as the keyways for insertion is of the same type.

Figure 6A:
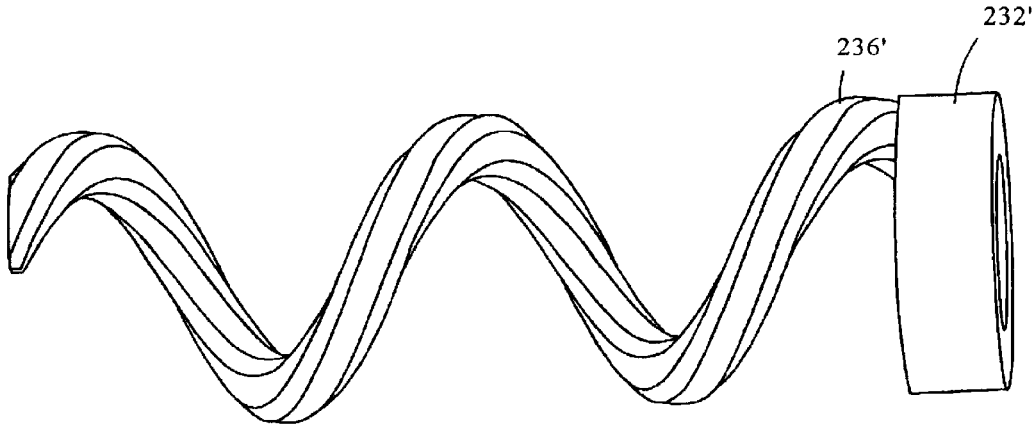
FIGS. 6A–D are different kinds of helical key blades that may be used in the present invention.
Figure 6B:
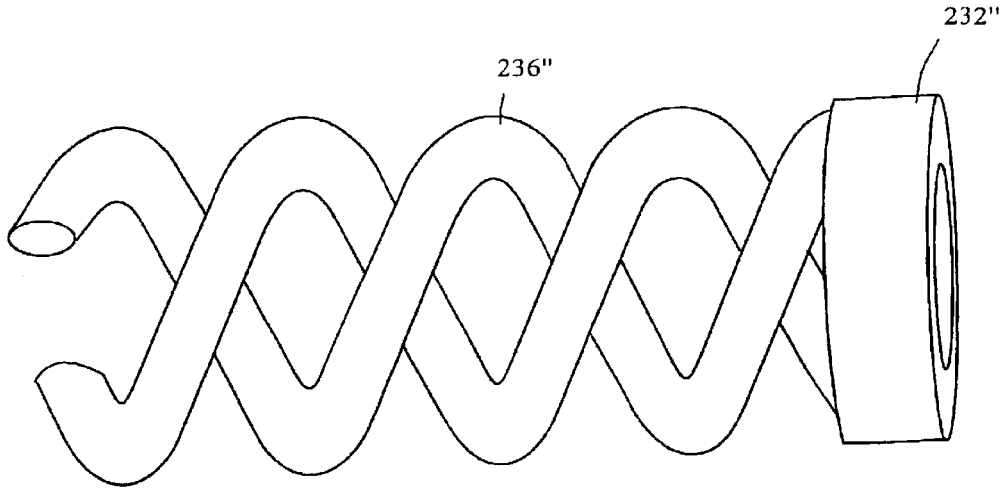
Figure 6C:
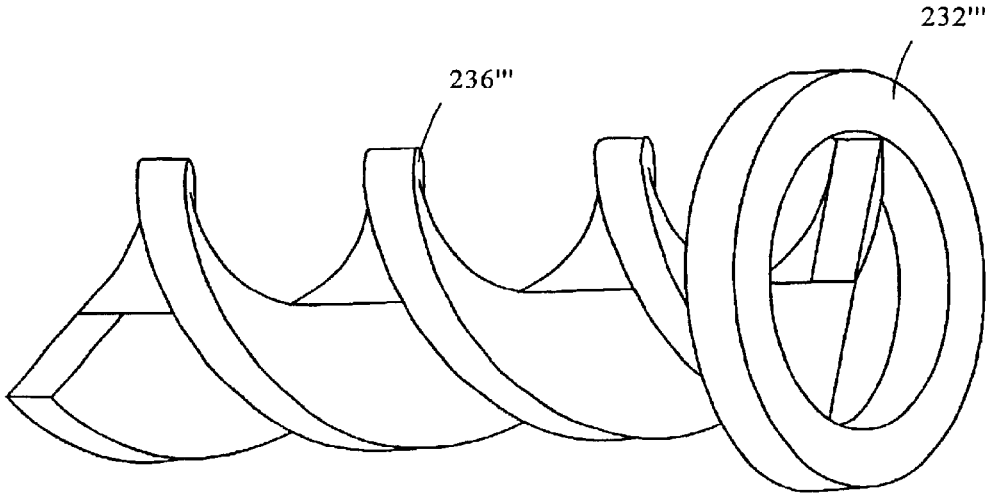
Figure 6D:
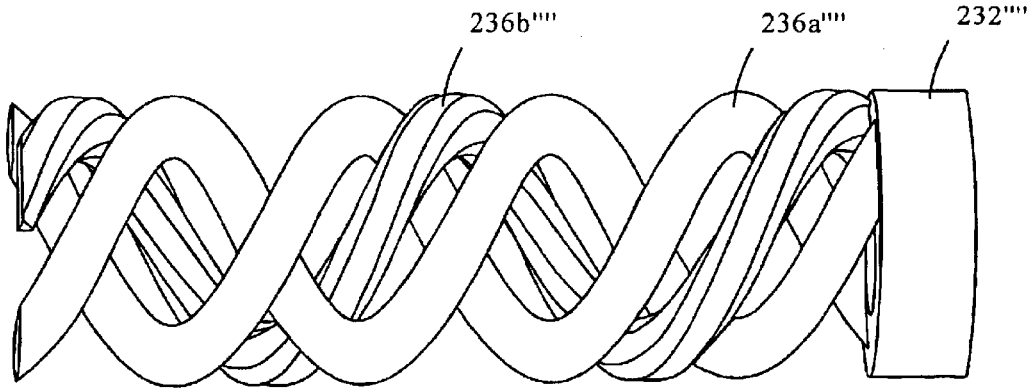

In the preferred embodiment, the helical key blades are of rectangular cross section, as shown in FIG. 5. Other type of cross section of the key blade such as polygon, round, etc. may also be used with the present invention, as can be seen in FIGS. 6A and 6B. Furthermore, in the present embodiment only two helical key blades are shown in the figures, persons skilled in the art should appreciate that more or less than two helical key blades may also be used with the present invention. For instance, the key may have only one helical key blade as shown in FIGS. 6A and 6C, wherein the key blade 236' of FIG. 6A is of polygonal cross section and the key blade 236''' of FIG. 6C is of elongated rectangular cross section and may not require a shank as described above. Alternatively, the key may have two helical key blades with different cross section, as can be seen in FIG. 6D, wherein one blade 236*a*'''' is with round cross section and the other blade 236*b*'''' is with polygonal cross section.

Figure 7A:
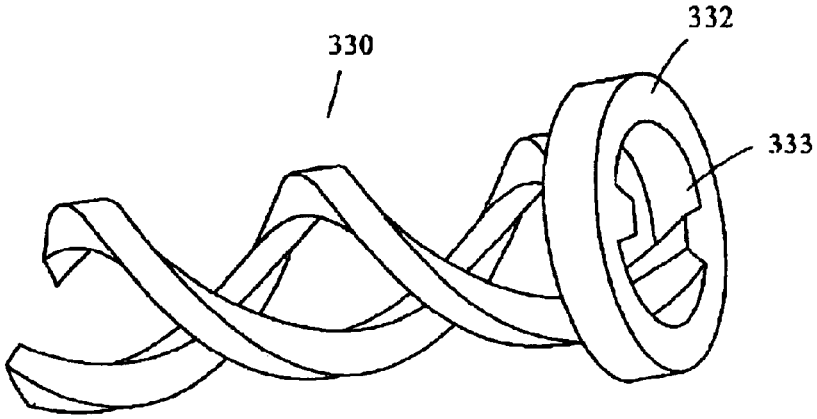
FIG. 7A is a perspective view of a second embodiment of the helical key blade according to the present invention.
Figure 7B:
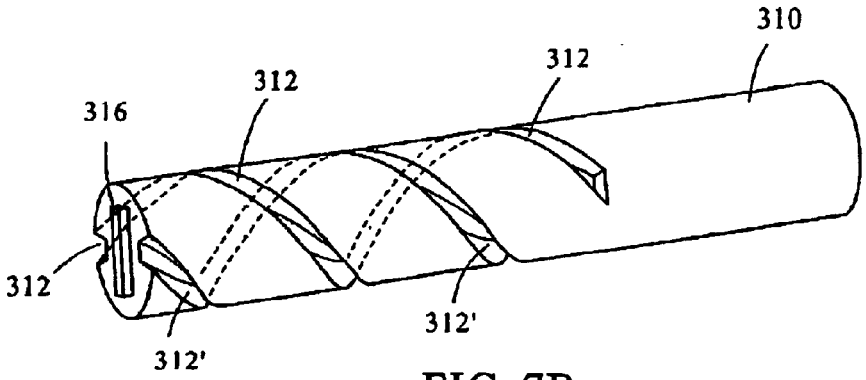
FIG. 7B is a perspective view of a second embodiment of a shank according to the present invention.
Figure 7C:
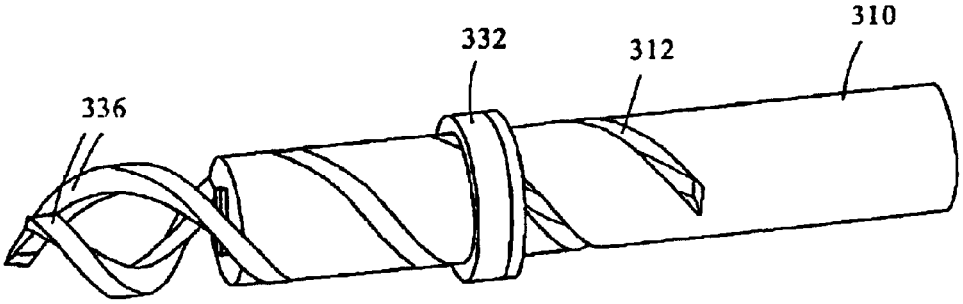
FIG. 7C is a perspective view of the helical key blade of FIG. 7A cooperated with the shank of FIG. 7B.

FIGS 7A–7C depict a second embodiment of the helical key blade and the shank according to the present invention. The key according to another embodiment of the present invention comprises two key blades 336 and a shank 310, wherein the other elements of the key such as head, driver head, bearing assembly, etc. are omitted since they are the same as those shown in FIGS. 3 and 4 and illustrated above. The key blades 336 respectively provided with rectangular cross section extend from the inner surface of the opening 333 of the blade head 332. The shank 310 is provided with a pair of helical grooves 312, 312' of a rectangular cross section that is the same as that of the key blades 336, 50 that the key blades 336 can fit into and move along the grooves 312,312'.

Based on the above-described construction, when a lock having at least one helical keyway according to the present invention is intended to be opened, the only useful tool to open the unique lock is an accompanying key having at least one corresponding helical key blade. In an open-lock operation, the protrusion 216 of the key is firstly inserted into the positioning slot 114 provided in the center of the front end of the lock core 110 for positioning and facilitating insertion of the key Each end of the helical key blade is then aligned with the entry of the keyway The driving head is moved forward along the grooves of the shank while the key blade portion is rotated with respect to the driving head and moved together with the head driver. When the driving head reaches to the terminals of the grooves, the key blades are fully inserted into the keyways of the lock core and engage the pin tumblers situated randomly around the keyways so that the core can be turned and the lock is thus be opened.

The lock of the present invention comprises a core and a shell. The core formed with at least one helical keyway and a plurality of pin tumbler bores next to the keyway can be made by methods such as fusing filling materials to a curved channel all around to form the core or fusing two left and right halves of die-casted core to form the core. The core with the assembled pin tumblers in the pin tumbler bores can then be fit into the shell by methods such as boring the core with hardened steel pins and holding the core inside with a ring shield, which together help to thwart the drilling the cylinder core out of the lock. The front end of the cylinder shell may be covered by a sheath of decorative metal. Moreover, the lock core is bored with hardened steel pins.

The key of the present invention can be made by method of die-cast. One can die-cast the key with materials that are known to confer sufficient stiffness such as iron, stainless steel, copper, etc. The material shall be chosen so that the stiffness of the key blade is sufficient enough to enable the long and thin helical key blades to fit wholly into the keyway and engage the pin tumblers to turn the core.

The helical key blade of the present invention is inserted into the keyway completely. Then, the contour profile of the key blade works against all of the pin tumblers to determine the respective meeting lines so that when the meeting line between the pin tumblers and the drivers coincide with the circumference of the core, the core may be turned.

Without the unique helical key according to the present invention, a lock breaker is unable to open the lock because the conventional lock breaking rod cannot be used in the lock of the present invention where the keyway is helical and curved. Furthermore, even with the use of a flexible rod that can curve along the keyway, the lock breaker is still unable to joggle the pin tumblers to the right place as he cannot see all of the pin tumblers due to the helical path of the keyway. One is unable to view the entire keyway as the view would be blocked by the helices. Even in the case of joggling the pin tumblers by sensing, without viewing, the pin tumblers with a rod, and one is able to feel all of the pin tumblers in the helical keyway, the helices of the keyway will restrict the curvature and movement of the rod. Such restriction will prevent the meeting line from coinciding with the circumference of the cylinder core, and the lock cannot be opened. For example, when a flexible rod is shoved into the helical keyway, the helices of the keyway cause the rod to be so curved that the rod pushes the first tumbler so that its meeting line is pushed up beyond the circumference of the cylinder core. The same problem applies to all subsequent pin tumblers. As long as one tumbler's meeting line fails to coincide with the circumference of the cylinder core, the lock cannot be opened. With such revolutionary helical keyway design, any rigid soft-steel material introduced into the lock will strike an obstacle and will be unable to penetrate far enough to trip the tumblers. It completely foils the attempt of the most accomplished lock-picker. The lock comes with its own helical key, which is the only tool can be used to open the lock. The helical keyway poses tremendous difficulty for lock breaker to joggle the pin tumblers by sight or by feel. Thus, the present invention is a fundamental improvement in enhancing the security of a lock.

It would be apparent to one skilled in the art that the invention can be embodied in various ways and implemented in many variations. Such variations are not to be regarded as a departure from the spirit and scope of the invention. In particular, the process steps of the method according to the invention will include methods having substantially the same process steps as the method of the invention to achieve substantially the same results. Substitutions and modifications have been suggested in the foregoing Detailed Description, and others will occur to one of ordinary skill in the art. All such modifications as would be obvious to one skilled in the art are intended to be included within the scope of the following claims and their equivalents.

What is claimed is:

1. A key comprising:

a key head;

a shank connected to said key head at a first end thereof and provided with a protrusion at a second end thereof, said shank having a pair of grooves extending oppositely laterally along a lengthwise direction thereof;

a driving head movably mounted on said shank, said driving head having an inner opening in the center thereof and a cavity in one side thereof, the inner opening provided with a pair of protrusions oppositely located in an inner surface thereof; and a key blade portion rotatably movably mounted on said shank, said key blade portion comprising a blade head having an inner opening, a bearing assembly disposed between the blade head and the cavity of the driving head, and at least one helical key blade extending from a periphery of the inner opening of said blade head.

2. The key according to claim 1, wherein said at least one helical key blade is formed with a rectangular, round, or polygonal cross section.

3. The key according to claim 1, wherein said at least one helical key blade comprises a contour profile thereon.

4. The key according to claim 1, wherein said bearing assembly comprises a first bearing member fixed in an inner surface of the cavity of said driving head and a second bearing member arranged adjacent to an outer surface of the blade head.

5. The key according to claim 1, wherein said blade head is generally of a cylindrical shape fitted in the cavity of said driving head and has an inner opening through which said shank can pass.

6. The key according to claim 1, wherein said at least one helical key blade is integrated with the blade head and extends along a longitudinal axis of the blade head from the periphery of the inner opening of the blade head.

7. The key according to claim 1, comprising two opposed helical key blades extending oppositely along a longitudinal axis of the blade head from the periphery of the inner opening of the blade head.

8. The key according to claim 7, wherein said two opposed helical key blades are of different cross sectional shapes.

9. The key according to claim 7, wherein said two opposed helical key blades are of different lengths.

10. The key according to claim 1 further comprising a fastening ring situated between the key blade portion and the driving head to retain the key blade portion within the cavity of the driving head.

11. The key according to claim 1, wherein said key blade portion is rotated in a first direction to insert said at least one helical key blade into a corresponding keyway of a lock and in a second direction to retract said at least one helical key blade from the corresponding keyway.

12. The key according to claim 1, wherein said at least one key blade comprises a surface contour thereon.

13. The key according to claim 1, wherein said shank further comprises at least one helical groove situated on the surface thereof for receiving said at least one helical key blade.

14. The key according to claim 7, wherein said shank further comprises two opposed helical grooves situated on the surface thereof for receiving said two opposed helical key blades.

15. The lock and key combination comprising:

a shell having a cylindrical opening;

a lock core rotatably mounted in said opening of said shell and having at least two helical keyways and at least one pin tumbler bore situated inside the lock core for receiving a pin tumbler; and a key having at least two helical key blades corresponding to said at least two keyways of said lock core, wherein said key further comprising:

a key head;

a shank connected to the key head, said shank having a pair of grooves oppositely laterally extending along a lengthwise direction thereof;

a driver head having an inner opening in the center thereof and a cavity in one side thereof, said inner opening provided with a pair of protrusions oppositely located in an inner surface thereof; and a key blade portion received in the cavity of the driver head, said key blade portion comprising a blade head having an inner opening, a bearing assembly disposed between the blade head and the cavity of the driver head, and at least two helical key blades extending from a periphery of the inner opening of said blade head.

16. The lock and key combination according to claim 15, wherein said at least two helical key blades are formed with a rectangular, round, or polygonal cross section.

17. The lock and key combination according to claim 15, wherein said at least two helical key blades further respectively comprises a contour profile thereon.

18. The lock and key combination according to claim 15, wherein said bearing assembly comprises a first bearing member fixed in the inner surface of the cavity of said driving head and a second bearing member arranged adjacent to an outer surface of the blade head.

19. The lock and key combination according to claim 15, wherein said blade bead is generally of a cylindrical shape and fitted in the cavity of said driving head and has an inner opening through which said shank is able to pass.

20. The lock and key combination according to claim 15, wherein said at least two helical key blades are integrated with the blade head and extend along a longitudinal axis of the blade head from the periphery of the inner opening of the blade head.

21. The lock and key combination according to claim 15, wherein said at least two helical key blades extend oppositely along a longitudinal axis of the blade head from the periphery of the inner opening of the blade head.

22. The lock and key combination according to claim 21, wherein said two opposed helical key blades are of different lengths.

23. The lock and key combination according to claim 15 further comprising a fastening ring situated between the key blade portion and the driving head to retain the key blade portion within the cavity of the driving head.

24. The lock and key combination according to claim 15, wherein said key blade portion is rotated in a first direction to insert said at least two helical key blades into corresponding keyways of a lock arid in a second direction to retract said at least two helical key blades from the corresponding keyways.

25. The lock and key combination according to claim 15, wherein said shank further comprises at least two helical grooves situated on the surface thereof for receiving said at least two helical key blade.

26. The lock and key combination according to claim 21, wherein said shank further comprises two opposed helical grooves situated on the surface thereof for receiving said two opposed helical key blades.

* * * * *